United States Patent [19]

Nihra

[11] 4,310,189

[45] Jan. 12, 1982

[54] GOLF BALL RETRIEVER

[76] Inventor: Joseph A. Nihra, 139 W. Robert St., Hazel Park, Mich. 48030

[21] Appl. No.: 113,555

[22] Filed: Jan. 21, 1980

[51] Int. Cl.[3] ..... G66F 11/00

[52] U.S. Cl. ..... 294/19 A

[58] Field of Search ..... 294/19 A, 19 R, 33, 294/99 R, 55.3, 103; 273/32 F, 32 R, 162 R, 162 E, 162 F

[56] References Cited

U.S. PATENT DOCUMENTS

| | | | |
|---|---|---|---|
| 2,523,942 | 9/1950 | Ciambriello | 294/19 A |
| 3,520,569 | 7/1970 | Anderson | 294/19 A |
| 4,180,288 | 12/1979 | Sievers | 294/79 A |

*Primary Examiner*—James B. Marbert
*Attorney, Agent, or Firm*—John P. Moran

[57] ABSTRACT

The disclosure describes and illustrates a golf ball retriever including a ring or loop secured to a telescopically collapsible handle and sized so as to be just barely smaller than the diameter of a standard golf ball. A series of embossments are formed around the full length of the inner peripheral surface of the ring to enhance the gripping characteristic thereof. The ring may be planar or non-planar in attitude, with the centerline of the series of embossments being formed either (1) along the centerline of the inner peripheral surface of the ring, or (2) spiralling with respect to such centerline from being principally on one side thereof to being principally on the other side thereof.

4 Claims, 6 Drawing Figures

GOLF BALL RETRIEVER

This invention relates generally to golf ball retrievers and, more particularly, to golf ball retrievers having a single gripping ring or loop capable of picking up a golf ball.

In view of the high prices of golf balls today, it is desirable for golfers to carry a golf ball retriever. The retriever should be lightweight, telescopally extendable to a substantial length, say, eighteen feet, capable of gripping a golf ball with a light touch, and usable to retrieve the ball from water and from beyond assorted hazards, such as a barbed wire or chain link fence, the ring being of a size which is capable of being extended through the openings of the chain link pattern.

Accordingly, it is a general object of the invention to provide an improved golf ball retriever having the above mentioned features.

Another object of the invention is to provide a golf ball retriever including an improved single ring or loop which is capable of gripping a golf ball with a light touch, even at an extended length, regardless of which side of the ring is placed in contact with the ball.

A further object of the invention is to provide a golf ball retriever wherein the ring thereof is specially embossed or engraved around its inner periphery to enhance the gripping characteristic thereof.

Still another object of the invention is to provide a golf ball retriever wherein the embossing around the inner periphery thereof spirals from being principally on one side of the inner centerline of the ring to being principally on the other side of the inner centerline.

A still further object of the invention is to provide a golf ball retriever wherein the embossing around the inner periphery of the ring thereof is formed by a criss-crossed impression die.

Still another object of the invention is to provide a golf ball retriever wherein the ring or loop thereof is formed, in one embodiment, so as to be non-planar in attitude.

These and other objects and advantages will become more apparent when reference is made to the following description and the accompanying drawings, wherein.

Figure 1:
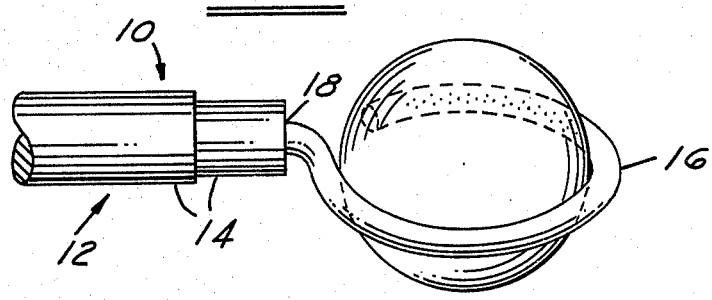
FIG. 1 is a fragmentary perspective view of a golf ball retriever embodying the invention and shown holding a golf ball.

Referring now to the drawings in greater detail, FIG. 1 illustrates a golf ball retriever 10 including a handle 12, which may consist of a plurality of three foot lengths of variable diameter tubing 14 telescopically assembled. A single ring or loop 16 is formed from a one quarter inch diameter aluminum rod into approximately seven eighths of a full circle. A stem 18 extends outwardly from one end of the loop 16 and is secured by any suitable means, such as staking, to the innermost, smallest diameter section of tubing 14.

Figure 3:
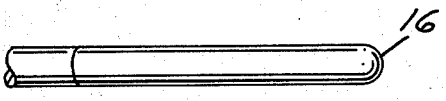
FIG. 3 is a side elevational view of the ring portion of FIG. 1.
Figure 4:
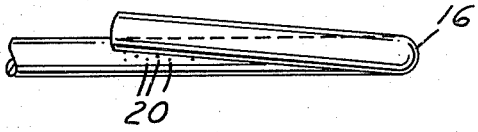
FIG. 4 is a side elevational view of an alternate embodiment of the ring portion of FIG. 1.

The loop 16 is sized so as to have an inner diameter just barely smaller than the maximum diameter of a standard golf ball. The loop may be formed flat, as shown in FIG. 3, but, preferably, is formed non-planar, as shown in FIG. 4. More specifically, in the latter embodiment it is formed as a segment of a spiralled coil.

Figure 6:
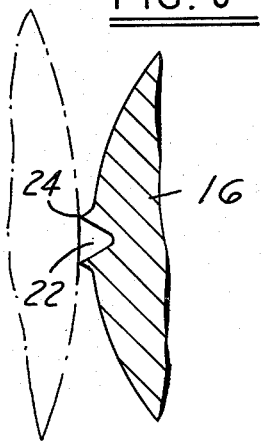
FIG. 6 is an enlarged fragmentary view of the invention in an operative condition.

A predetermined pattern of specially formed embossments 20 is formed on the inner peripheral surface of the loop 16, along the full length thereof. The embossments are the result of the loop being formed or cold rolled around a round die (not shown) having a criss-crossed or knurled impression formed thereon. As better shown in FIG. 6, exaggerated for the sake of clarity, each embossment 20 is formed by virtue of a pointed impression on the die having formed a conical hole 22, displacing the metal therefrom into an annular ridge 24 at the edge thereof. The pattern of the embossments is a series of diamond shaped configurations, with an embossment located at each apex of the diamond.

Figure 2:
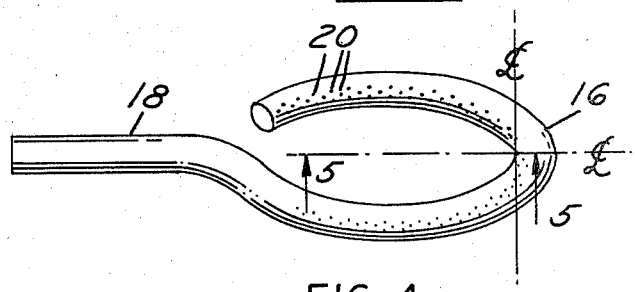
FIG. 2 is a perspective view of the ring portion of FIG. 1.
Figure 5:
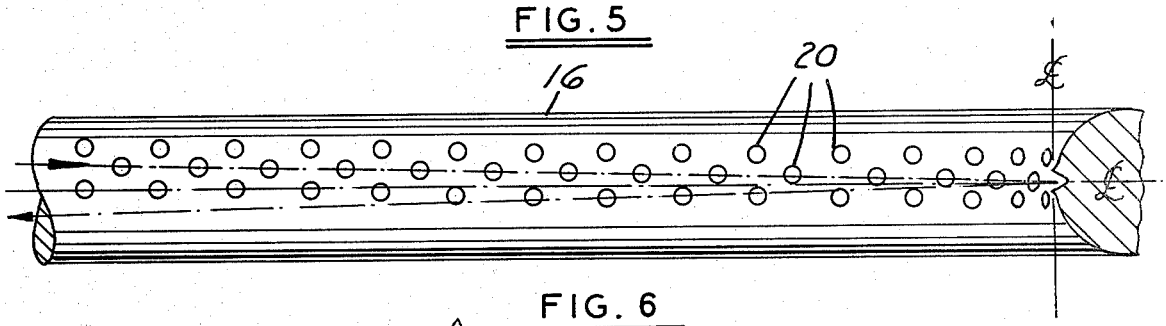
FIG. 5 is an enlarged view of a portion of the invention taken along the plane of line 5—5 of FIG. 2, and looking in the direction of the arrows.

The location of the series of embossments 20 is either (1) straddling the centerline of the inner peripheral surface, with the width thereof equally distributed on both sides of the centerline, as represented in FIG. 2, or (2) such that its width is extended further on one side of center at one end of the loop, and spiralled relative to the loop to terminate with its width extended further on the other side of center at the other end of the loop, as illustrated in FIG. 5. The latter arrangement serves to better assure a gripping action regardless of which side of the loop contacts the ball.

In operation, the ring or loop 16 need only be extended through any opening of a chain link fence, for example, and touched down lightly on a golf ball from either side of the ring at random, in order to firmly grip the otherwise abandoned ball and retrieve it. In water, the same light touch will suffice when the ball is lying on a solid surface. On any soft base, such as mud, sand or grass, the loop 16 may be slid beneath the ball, to thus serve as a scoop or seat for lifting the ball.

The gripping action is greatly enhanced by the ridges 24 (FIG. 6) engaging the surface of the golf ball, either in or adjacent the dimples of a conventional golf ball, thereby serving to efficiently grip and retain the ball until the tubes 14 are telescopically retracted, and the ring or loop end is returned to the hands of the operator.

It should be apparent that the invention provides an improved, compact, lightweight, and efficient means for retrieving a golf ball.

While but two basic embodiments of the invention have been shown and described, other modifications thereof are possible.

What is claimed is:

1. A golf ball retriever comprising a handle, a stem fixedly secured at one end thereof to an end of said handle, a loop formed on the other end of said stem with the ends thereof spaced apart, and a plurality of embossments formed around the inner peripheral surface of said loop along the centerline thereof, the centerline of said plurality of embossments spiralling from being principally on one side of the centerline of said inner peripheral surface of said loop to being principally on the other side of said centerline of said inner peripheral surface, thereby enhancing the gripping characteristics thereof when either side of the loop, at random, is brought into contact with a golf ball.

2. A golf ball retriever comprising a handle, a stem fixedly secured at one end thereof to an end of said handle, a loop formed on the other end of said stem substantially as a segment of a spiral, and a plurality of embossments formed around the inner peripheral surface of said loop so as to spiral along with the centerline of said loop.

3. The golf ball retriever described in either of claims 1 or 2, wherein said plurality of embossments is formed in a series of diamond shaped configurations.

4. The golf ball retriever described in either of claims 1 or 2, wherein each embossment consists of a conical hole having an annular ridge formed therearound, with an embossment being located at each apex of the diamond shape.

* * * * *